US005978718A

United States Patent [19]

Kull

[11] Patent Number: 5,978,718

[45] Date of Patent: Nov. 2, 1999

[54] RAIL VISION SYSTEM

[75] Inventor: Robert C. Kull, Olney, Md.

[73] Assignee: Westinghouse Air Brake Company, Wilmerding, Pa.

[21] Appl. No.: 08/898,648

[22] Filed: Jul. 22, 1997

[51] Int. Cl.[6] ..... B61L 3/00; B61L 29/00

[52] U.S. Cl. ..... 701/19; 701/20; 246/167 R; 340/937

[58] Field of Search ..... 701/19, 20; 246/167 R, 246/182 R, 122 R; 340/902, 937

[56] References Cited

U.S. PATENT DOCUMENTS

| | | | |
|---|---|---|---|
| 5,415,369 | 5/1995 | Hungate | 246/167 R |
| 5,452,870 | 9/1995 | Heggestad | 246/182 R |
| 5,620,155 | 4/1997 | Michalek | 340/902 |
| 5,699,986 | 12/1997 | Welk | 246/125 |

*Primary Examiner*—Tan Nguyen
*Attorney, Agent, or Firm*—James Ray & Associates

[57] ABSTRACT

A rail vision system visually reads signal aspect information from each wayside signal device of a wayside signaling system. It also warn a train operator of the more restrictive signal aspects and imposes a penalty brake application should the train operator fail to acknowledge the warning. Each wayside signal device communicates from a railway operating authority information including directions as to how the train should proceed along the upcoming segment of railway track. The rail vision system includes a signal locating system and a rail navigation system. The signal locating system isolates visually the upcoming wayside signal device and reads the information therefrom as the train approaches thereto. The rail navigation system determines the position that the train occupies on the railway track and provides the signal locating system with data as to the whereabouts of the upcoming wayside signal device relative to the position of the train. This enables the signal locating system to isolate visually the upcoming wayside signal device and to provide the information read therefrom to the rail navigation system. The rail navigation system can then warn the train operator of the more restrictive signal aspects, and should the train operator fail to acknowledge the warning, impose a penalty brake application.

21 Claims, 2 Drawing Sheets

RAIL VISION SYSTEM

CROSS-REFERENCE TO RELATED APPLICATIONS

This application is related to a copending U.S. application entitled INTEGRATED CAB SIGNAL AND RAIL NAVIGATION SYSTEM, Ser. No. 08/898,373, filed currently herewith on Jul. 22, 1997. The copending application is assigned to the assignee of the present invention, and its teachings are incorporated into the present document by reference.

FIELD OF THE INVENTION

The present invention generally relates to a system used to enforce braking of a train in compliance with the signal aspect information received from the wayside signal devices of a wayside signaling system. More particularly, the present invention relates to a rail vision system that can visually read the signal aspect information as the train approaches each wayside signal device and operate the brakes in compliance therewith. Still more particularly, the rail vision system can be used merely to warn a train operator of only the more restrictive signal aspects received from a wayside signal device and, should the train operator fail to acknowledge the warning, impose a penalty brake application.

BACKGROUND OF THE INVENTION

A railway operating authority is responsible for conducting rail traffic safely along the railway track routes under its control. The movement of one or more trains along a railway track route can be governed in a variety of ways. For multiple trains travelling on an unsignaled route (i.e., in dark territory), the operating authority typically issues orders by radio to the operator of each train so as to maintain adequate separation between trains and otherwise safely guide each train through such territory. For trains travelling on a route equipped with a wayside signaling system, the operating authority guides each train via wayside signal devices dispersed at various intervals throughout the length of the railway route. Though trains can be guided safely along unsignaled routes, wayside signaling systems are preferable, especially on heavily trafficked routes, as they can be used to guide trains even more safely and more quickly along such signaled routes with less distance between them.

It is well known that a wayside signaling system is used to communicate signal aspect information to a train as it travels along the railway route. One type of wayside signaling system features a continuous succession of DC train detection circuits along the entire length of the railway route through which to control a multiplicity of wayside signal devices spaced apart from each other along the route. Each train detection circuit covers a section of track approximately 10,000 feet in length and is electrically isolated from the next detection circuit via an insulated joint situated between each track section. Each train detection circuit merely detects whether its section of track is occupied by a train and communicates a signal indicative of same to its corresponding wayside signal device. For this type of wayside signaling system, each wayside signal device typically takes the form of a display of colored lights or other indicia through which to visually communicate signal aspect information to a train operator. It is the signal aspect information that denotes the condition of the upcoming segment of track, i.e., whether it is clear, occupied by a train or subject to some other speed restriction.

Each signal aspect is conveyed by a color or combination of colors and denotes a particular course of action required by the operating authority. The particular colors of red, yellow and green generally denote the same meaning as when used on a standard traffic light. In a four aspect wayside signaling system, for example, the following scheme may be employed: green for clear, yellow and green for approach medium, yellow for approach, and red for restricted/stop. If a train is detected on a section of track, the train detection circuit corresponding thereto informs its corresponding wayside signal device. As the train approaches a track segment over which the wayside signal device has coverage, the railway authority that operates that segment then uses the wayside signal device to communicate visually the appropriate signal aspect to the train operator.

Another type of wayside signaling system also features the continuous succession of DC train detection circuits along the railway track route. They, too, are used to control the wayside signal devices spaced along the route. Each of the wayside signal devices in this type of signaling system also includes an AC track circuit that accompanies or overlays each DC train detection circuit and serves to supplement its visual display. Each wayside signal device through its AC track circuit communicates over the rails the signal aspect information (i.e., the cab signal) up to a range of approximately 5,000 feet. As a train rides on the rails, the cab signal is sensed by pick up coils mounted in front of the leading axle of the locomotive. The cab signal is filtered, decoded and eventually conveyed to a cab signal device located in the cab of the locomotive. The cab signal device typically includes a display of colored lights to convey visually the signal aspect information so that the train operator will be kept apprised of the signal aspect applicable to the upcoming segment of track.

Most railway operating authorities such as Conrail and Union Pacific, for example, use the four aspect system to communicate the condition of the upcoming track segment. Each of the wayside signal devices in such a system typically takes the form of an AC power frequency track circuit from which a carrier frequency typically ranging between 50 to 100 Hertz carries the cab signal in coded format. In this four aspect wayside signaling system, each signal aspect is communicated via electrical pulses in the aforementioned way to the cab signal device using the following preset code rates: 180 pulses per minute for Clear, 120 for Approach Medium, 75 for Approach, and 0 for Restricted/Stop. Each of the latter three aspects imposes a restriction in the speed with which the train may proceed along that segment of railway track.

Two trains travelling in the same direction along a railway route equipped with a three aspect wayside signaling system may be directed, for example, as follows. One train approaches a wayside signal device that is displaying a green/clear aspect indicating that it is clear to proceed on the upcoming segment of track. Meanwhile another train situated two segments ahead is stopped on a track segment whose wayside signal device is displaying a red/stop aspect. The next signal that the trailing train encounters is a yellow/approach aspect because the leading train is occupying the track segment governed by the wayside signal device that is displaying the red/stop aspect. The yellow/approach aspect typically indicates that the trailing train must reduce its speed and be prepared to stop before encountering the track segment covered by the next wayside signal device. If the leading train still has not moved, the trailing train must stop before it reaches the next wayside signal device because that signal device is the one that is still displaying the red/stop aspect.

Railway equipment manufacturers have offered a variety of systems whose objective is to operate the brakes of a train in compliance with such directions issued by the railway operating authorities. These systems typically employ the cab signal devices in conjunction with automatic train protection (ATP) systems. By processing the directions received from the wayside signaling systems according to known principles, such prior art devices and systems are used to derive, and require the train to comport with, braking profiles. These prior art systems typically brake the train automatically when the train operates contrary to the limits imposed by the braking profiles and thus contrary to the wayside signaling system on which the train is riding.

The cab signal device thus typically features an audible warning device and an acknowledgment input. The acknowledgment input allows the train operator to acknowledge the more restrictive signal aspects and thereby prevent a penalty brake application. For example, when the train encounters a segment of track over which one of the speed restrictions is in force and the train is nevertheless permitted to exceed the speed restriction, the cab signal device will activate the audible warning device. If the train operator does not initiate a service brake application so that the train comports with the calculated speed distance braking profile, the cab signal device will automatically impose a penalty brake application to stop the train. The cab signal device typically provides power continuously to a feed circuit to energize, and thus keep closed, an electropneumatic valve. Should the train run afoul of the speed distance braking profile, the cab signal device denergizes the valve to vent the brake pipe to atmosphere thereby applying the brakes. In newer locomotives equipped with modern brake control systems such as the WABCO EPIC® system, the cab signal device offers a similar input to the electronic brake control system to provide the same function.

Some cab signal devices also offer overspeed protection as an optional feature. A speed sensing device provides an indication of speed to the cab signal device. The cab signal device automatically shuts down the engine of the locomotive if the speed of the train exceeds a predetermined value.

The territorial coverage of the DC train detection circuits and the wayside signal device AC track circuits is typically not coextensive. Whereas each DC train detection circuit covers a section of track approximately 10,000 feet in length, each wayside signal device through its AC track circuit can typically apply its cab signal on a reliable basis to a range of about 5,000 feet. Consequently, repeater units are often used to fill the gaps so as to provide continuous cab signal coverage between wayside signal devices.

The cab signal devices on present day trains are designed to operate on wayside signaling systems that provide continuous coverage over the entire track route. Should a wayside signal device or a repeater unit fail, the cab signal device will interpret the loss of signal aspect information as a stop aspect and automatically impose a penalty brake application. Though the train operator can typically prevent a penalty brake application by acknowledgment or other actions, it is generally not operationally acceptable to routinely require repeated wayside signal "cut-out" and "cut-in" procedures to cover such loss of coverage. Though such wayside signaling systems are widely used on both freight railroads and passenger transit properties, they have not been extensively deployed on the longer freight railroad routes. This is primarily due to cost considerations . It is quite expensive to equip railway track routes with wayside signal devices let alone the necessary repeater units. The need for repeater units alone can often more than double the cost of implementing a wayside signaling system. This increase in cost is due to the need for infrastructure such as acquiring sites at which to install the equipment and providing the foundations, equipment housings and power access at those sites. Many railway routes therefore have the type of wayside signaling system in which there are gaps in cab signal coverage because repeater units either are not used or only used in certain places.

For heavy freight trains with conventional continuous cab signal devices, it is generally not practical to provide automatic train stop techniques to enforce braking. Several factors such as the braking characteristics, the signal block lengths and grades for any given train and terrain are not known and thus worst case conditions would therefore have to be assumed. This would result in overly restrictive braking curve assumptions for most cases, which would affect train operations too severely to be practical. Consequently, most freight train operators with continuous cab signal devices (e.g., Conrail and Union Pacific Railroads), provide only a warning of the more restrictive signal aspects, with an acknowledgment requirement. The penalty brakes are applied automatically only if the train operator fails to acknowledge the more restrictive signal aspects. The train operator can thus satisfy the acknowledgment requirement, yet still not apply the brakes so as to stop the train before approaching a red signal.

Yet another type of wayside signaling system also features the continuous succession of DC train detection circuits along the railway track route. They, too, are used to control the wayside signal devices spaced along the route. In this type of wayside signaling system, however, each of the wayside signal devices controls a track transponder located at a fixed point along the track before each wayside signal device. When a train is detected on a section of track, the train detection circuit corresponding thereto informs its corresponding wayside signal device. The train, however, can only receive the signal aspect information from the transponder as it passes by each fixed point. By using the track transponders to transmit additional encoded data such as the profile of the upcoming track segment and the signal block length, a train equipped with an automatic train protection (ATP) system is able to enforce braking on routes covered by such a wayside signaling system.

The primary disadvantage of transponder based ATP systems is that trains so equipped are required to pass discrete points on the railway track to receive the updated signal aspect information. Some railway authorities have therefore used radio systems to supplement the information received from the track transponders. Other authorities have used fixed transponders only, with updated information transmitted by radio from the wayside signal devices.

Another shortcoming common to all transponder based ATP systems is that they are rather expensive to install and maintain. Maintenance, for example, typically requires replacement of transponders that are damaged. Maintenance may also require a change in the codes or the locations of the transponders as the configuration of the railway track may well be changed over time.

Current automatic train protection systems present significant disadvantages whether used in connection with wayside signaling systems featuring wayside signal devices having AC track circuits or fixed point transponders. For wayside signaling systems featuring wayside signal devices featuring AC track circuits, it is expensive to equip railway routes with repeater units to prevent gaps in coverage from which signal aspect information would be unavailable.

Moreover, the cab signal device will interpret such loss of the cab signal as a stop aspect and automatically impose a penalty brake application. For wayside signaling systems featuring wayside signal devices featuring fixed point transponders, a train equipped for travel on such routes is required to pass fixed points to receive the updated signal aspect and guidance information from the transponders. Transponder systems are also expensive to install and maintain.

There is therefore a need in the railroad industry for a system that could operate the brakes of a train in compliance with a wayside signaling system without the aforementioned disadvantages. Specifically, it would be quite desirable to develop a system that can visually read the signal aspect information from each wayside signal device of a wayside signaling system. Such a system could be designed to operate on any type of wayside signaling system that visually displays the signal aspect information.

Related to the invention is subject matter described and claimed in a copending application entitled Rail Navigation System, U.S. Ser. No. 08/604,032, filed Feb. 20, 1996. This copending application is assigned to the assignee of the present invention, and its teachings are incorporated into the present document by reference. The rail navigation system allows a train to locate the position it occupies on a railway track route.

As best described in the cited document, the rail navigation system features a database including data pertaining to the locations of railway track routes and the locations and orientations of curves and switches in those railway track routes. It also receives inputs from devices such as an odometer, a rate of turn measuring apparatus and a navigational receiver. According to instructions contained within its programming code, the rail navigation system uses the aforementioned data along with and in comparison to the enumerated inputs to determine where the train is located in relation to track route location data stored in the on-board database. Through such processing, the coordinates the train occupies on the globe are matched against the database information to determine not only on which track the train is traveling but also the particular position that the train occupies on that track.

It should be noted that the foregoing background information is provided to assist the reader in understanding the instant invention. Accordingly, any terms used herein are not intended to be limited to any particular narrow interpretation unless specifically stated otherwise in this document.

OBJECTIVES OF THE INVENTION

It is, therefore, a primary objective of the invention to visually read signal aspect information from each wayside signal device of a wayside signaling system as the train approaches thereto and operate the brakes in compliance therewith.

Another objective is to visually read signal aspect information from each wayside signal device of a wayside signaling system and warn a train operator of only the more restrictive signal aspects and impose a penalty brake application should the train operator fail to acknowledge the warning.

Yet another objective is to provide a rail vision system that can visually determine whether an upcoming crossing is obstructed and automatically warn the train operator accordingly.

Still another objective is to visually determine when an upcoming crossing is obstructed and automatically make a visual record of the encounter between the train and the crossing.

Even another objective is to integrate video signal processing techniques into a rail navigation system so that the task of visually reading and acting upon signal aspect information from the wayside signal devices of a wayside signaling system is both technically practical and economically feasible.

A further objective is to develop a rail vision system that can be used with a wayside signaling system whose coverage does not extend throughout the entire railway route.

Yet a further objective is to develop a rail vision system that can operate the brakes of a train in compliance with a wayside signaling system without the need to retrofit or otherwise modify the existing infrastructure of the wayside signaling system.

Still a further objective is to develop a rail vision system capable of acting as an automatic train protection system and one that can be implemented on nearly all types of trains with minimum affect on current train handling practices and operations.

Even a further objective is to implement a rail vision system capable of performing generally the same functions as, and at lower cost than, alternative radio based "Positive Train Separation" and "Advanced Train Control" systems currently being considered or developed by other manufacturers.

Yet a further objective is to develop a rail vision system that can be incrementally incorporated into more and more trains on an individual basis without requiring that every train operating in the same area be equipped before any one train can derive the advantages of using the present invention.

In addition to the objectives and advantages listed above, various other objectives and advantages of the invention will become more readily apparent to persons skilled in the relevant art from a reading of the detailed description section of this document. The other objectives and advantages will become particularly apparent when the detailed description is considered along with the attached drawings and with the appended claims.

SUMMARY OF THE INVENTION

In a first presently preferred embodiment, the invention provides a rail vision system for a train that is designed for travel along a railway track featuring a multiplicity of wayside signal devices. Each wayside signal device communicates from a railway operating authority information as to how the train should proceed along the upcoming segment of railway track. The rail vision system includes a signal locating system and a rail navigation system. As the train approaches each wayside signal device, the signal locating system isolates visually the upcoming wayside signal device and reads the information when available therefrom. The rail navigation system determines the position that the train occupies on the railway track and provides the signal locating system with data as to the whereabouts of the upcoming wayside signal device relative to the position of the train. This enables the signal locating system to isolate visually the upcoming wayside signal device when the train approaches thereto. When the information is available, the signal locating system reads it and then provides it to the rail navigation system. The rail navigation system operates the brakes of the train in compliance with the wayside signaling system whether the particular track segment that the train is encountering is covered by a wayside signal device and whether the information is actually received as the train approaches that particular segment of track.

In a second presently preferred embodiment, the invention provides a rail vision system for a train that is designed for travel along a railway track featuring a multiplicity of wayside signal devices. Each wayside signal device communicates from a railway operating authority information including directions as to how the train should proceed along the upcoming segment of railway track. The rail vision system includes a signal locating system and a rail navigation system. The signal locating system isolates visually the upcoming wayside signal device and reads the information therefrom as the train approaches thereto. The rail navigation system determines the position that the train occupies on the railway track and provides the signal locating system with data as to the whereabouts of the upcoming wayside signal device relative to the position of the train. This enables the signal locating system to isolate visually the upcoming wayside signal device and to provide the information read therefrom to the rail navigation system. The rail navigation system can then warn a train operator of the more restrictive of the directions, and should the train operator fail to acknowledge the warning, impose a penalty brake application.

In a third presently preferred embodiment, the invention provides a rail vision system for a train that is designed for travel along a railway track having a multiplicity of highway or any other crossings intersecting therewith. The rail vision system includes a signal locating system and a rail navigation system. The signal locating system isolates visually the upcoming crossing as the train approaches thereto. The rail navigation system determines the position that the train occupies on the railway track and provides the signal locating system with the whereabouts of the upcoming crossing relative to the position of the train. This enables the signal locating system to isolate visually the upcoming crossing and to inform the rail navigation system as to the condition of the upcoming crossing. As the train approaches the upcoming crossing, the rail navigation system can then warn the train operator when the upcoming crossing is obstructed.

DETAILED DESCRIPTION OF THE INVENTION

Figure 1:
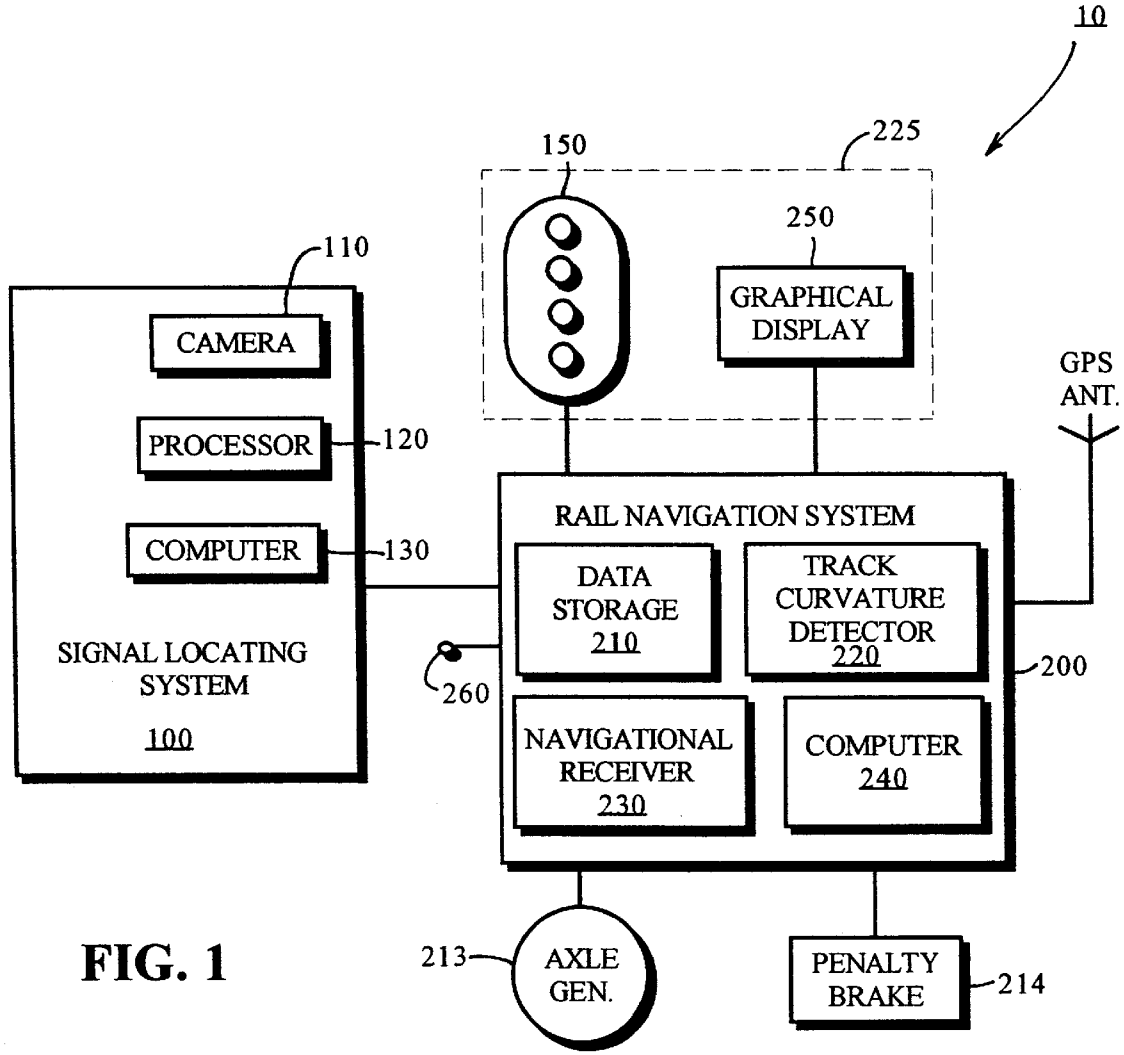
FIG. 1 illustrates in block form the first and second presently preferred embodiments of a rail vision system for a train.

Before describing the invention in detail, the reader is advised that, for the sake of clarity and understanding, identical components having identical functions in each of the accompanying drawings have been marked where possible with the same reference numerals in each of the Figures provided in this document.

FIG. 1 illustrates a presently preferred first embodiment of the invention, specifically, a rail vision system capable of functioning as an automatic train protection system. It is intended for use on trains designed for travel along a railway track featuring a multiplicity of wayside signal devices. It is well known that each wayside signal device communicates from a railway operating authority signal aspect information as to how the train should proceed along the upcoming segment of railway track. This rail vision system can visually read the signal aspect information as the train approaches each wayside signal device and operate the brakes in compliance with the wayside signaling system.

The rail vision system 10 in its most basic form comprises a signal locating system 100 and a rail navigation system 200. The signal locating system 100 features an input means 110, a processing means 120 and, optionally, a computing device 130 depending on how the overall system 10 is configured. The input means 110 can take the form of any one of a variety of known cameras including the types of cameras that feature aiming and zooming mechanisms that can be externally controlled to aim the camera at an upcoming object with high clarity even at relatively long distances. It is to be used to generate a video signal indicative of an image of the object, such as an upcoming wayside signal device, onto which it is focused. The processing means 120 may take the form of any one of several types of hardware and software embodiments known in the signal processing art. Using any number of well established signal processing techniques, the processing means 120 is to be used to process the video signal generated by the camera 110 so that the upcoming wayside signal device, and the signal aspect information if appearing thereon, is rendered discernable. The particular technique and hardware/software embodiment one selects to implement the processing means 120 will, of course, depend primarily on cost.

The rail navigation system 200 includes a storage device 210, a speed sensing device 213, a rate of turn measuring apparatus 220, a navigational receiver 230 and a computer 240. The storage device 210 is primarily used to store a database composed of a variety of information. As recited in the aforementioned document bearing U.S. Ser. No. 08/604,032, the database includes data pertaining to (i) the locations of railway track routes and (ii) the locations and orientations of curves and switches in those railway track routes. New to the present invention, however, the database also features data pertaining to (iii) the location of each wayside signal device on each railway track route, (iv) the type of each wayside signal device (e.g., background shape, number of lights, possible color combinations), (v) the direction which each wayside signal device points (e.g., eastbound or westbound, etc.) and the particular track which each wayside signal device signals (e.g., main track or siding), (vi) the position of each wayside signal device with respect to the particular track and the direction which the train is travelling (e.g., to the right, left, overhead), (vii) the distance from each wayside signal device at which imaging of the object should start, (viii) the signal number that appears on the signboard of each wayside signal device so equipped, and (ix) the position of the signboard for each wayside signal device so equipped. As explained below, the database may also feature data pertaining to (x) the location of every highway or other type of crossing on all relevant railway track routes and (xi) the distance from each crossing at which imaging should start. This location data is pegged to the identity of each railway route typically by reference to milepost distances.

The speed sensing device 213 can take the form of an axle generator, a traction motor speed sensor or other type of known device. It is used to sense the rotation of one of the axles of the locomotive through which it generates a first signal from which the speed of the train can be determined. Speed sensing device 213 can take the form of an odometer to determine the distance that the train has traveled over time. The signal from the odometer could be differentiated in time to ascertain the speed of the train.

The rate of turn measuring apparatus 220 and the navigational receiver 230 are described in the aforementioned document bearing U.S. Ser. No. 08/604,032. The rate of turn measuring apparatus 220 measures the rate at which the train turns while traveling on curves in the railway track. It may take the form of a gyroscope through which to generate a second signal from which curvature of the railway track can be determined. The navigational receiver 230 is used to determine the position that the train occupies on the globe. It is preferred that the navigational receiver 230 take the form of a GPS receiver which can receive global coordinates, such as latitude and longitude, from earth orbiting satellites. The GPS receiver may also be used to provide heading information. The GPS receiver should be accurate enough to identify a curve or a switch on which the train is located. It is anticipated, however, that it will not be accurate enough to determine on which set of adjacent, parallel tracks the train may be located. Thus the data that the GPS receiver itself may provide may only be an approximation of the exact location that the train occupies on the globe. It is this navigational receiver 230 that generates a third signal indicative of the approximate position of the train about the railway track.

According to instructions contained within its programming code, the computer 240 uses the enumerated signals along with and in comparison to the aforementioned data to determine not only the position that the train occupies on the railway track but also the whereabouts of the upcoming wayside signal device relative to the position of the train. Specifically, the computer 240 determines where the train is located in relation to the track route location data stored in the onboard database. Through such processing, the coordinates the train occupies on the globe are matched against the database information to determine not only on which track the train is traveling but also the particular segment and position that the train occupies on that track.

Whether continuously or at predetermined intervals, the computer 240 updates the expected location and position of the upcoming wayside signal device, relative to the position of the train, as the train continues its approach to it. It is expected that frequent updating will improve the ability of the system to locate the upcoming wayside signal device especially when the train approaches it along a curved track from which the viewing angle may vary significantly. Apprised of the expected location and position by the computer 240, the computing device 130 of the signal locating system 100 directs the camera 110 to focus on the upcoming wayside signal device. Processing the video signal generated by the camera 110, the processing means 120 attempts to render the upcoming wayside signal device, and the signal aspect information appearing thereon, discernable. This involves identifying the portion of the video image in which to look for the wayside signal device and the signal aspect information it conveys. The computing device 130 conveys to the computer 240 the signal aspect as read and a confidence factor based on the quality of the sighting. The identification of each wayside signal device can also be used to corroborate the calculations of the computer 240 as to, for example, the track on which the train is traveling and the position that the train occupies on that track.

The signal locating system 100, in its initial sighting, is unlikely to read the signal number that appears on the signboard of the upcoming wayside signal device. The signal aspect information, moreover, could change as the train approaches the upcoming wayside signal device. Apprised of the location and position of the upcoming wayside signal device by computer 240, the signal locating system 100 will continue to track the wayside signal device and report any change in signal aspect as it occurs. When the signal number on the signboard can be read (where applicable), the signal locating system 100 will pass that information to the computer 240. When the computer 240 determines that the train shall soon pass the upcoming wayside signal device, it will inform the signal locating system 100 accordingly. The computer 240 will use the last reported signal aspect information to operate the brakes of the train in compliance with signal aspect information received from the upcoming wayside signal device.

It should be apparent that the functions attributed to the computing device 130 of the signal locating system 100 and the those attributed to the computer 240 of the rail navigation system 200 could essentially be performed by one computer. Accordingly, the computer 240 could perform some or even more of the functions ascribed to the computing device 130 or to the other components of the signal locating system 100.

According to this first embodiment of the invention, the computer 240 can operate the brakes of the train in compliance with the wayside signaling system whether the particular track segment that the train is encountering is covered by a wayside signal device and whether the signal aspect information is actually received as the train approaches that particular segment of track. Apprised of the position of the train, the computer 240 determines whether and how the brakes of the train will be operated should the train operator be required and fail to operate the brakes according to one or more braking profiles calculated by the computer.

The computer 240 continuously updates the braking profiles based on a variety of parameters including the aforementioned data, the enumerated signals, and the signal aspect information obtained from the last wayside signal device. The process through which the braking profiles are calculated is, of course, well known in the train braking art. Typically two sets of braking profiles will be computed, one for full service braking and the other for emergency braking. Each braking profile will be calculated as a speed distance curve from a target stopping point.

The braking profiles will be used to enforce the wayside signaling system in a manner least disruptive to train handling and normal operations. The last signal aspect information received will be used to determine the extent of the current operating authority for the train. Using the current position of the train and the desired point at which the train should be stopped or slowed to a given speed, the computer 240 continuously calculates two speed-distance braking profiles. Using the desired rate for full service braking, the service braking profile is derived so that a full service brake application would be able to stop or slow the train over the distance between the current position of the train and the desired stopping point. Using the desired rate for emergency braking, the emergency braking profile is derived so that an emergency brake application would be able to stop the train in the distance between the current position of the train and the desired point. Should the train be operating in a manner that is contrary to the signal aspect information and at least one of the braking profiles, the rail vision system 10 in this first embodiment will brake the train accordingly. Unlike prior art automatic train protection systems, the rail vision system 10 operates the brakes in compliance with the wayside signaling system without the need for AC track circuits, transponders or radio to communicate the signal aspect information.

The rail vision 10 may also include an acknowledgment input 260 whose output is provided to the computer 240. The acknowledgment input 260 could preferably be used to silence the audible and visual warning devices that would be generated following a failure to respond to the more restrictive signal aspects. The automatic train protection function of this first embodiment largely obviates conventional uses of the acknowledgment input (i.e., preventing a penalty brake application).

The rail vision system 10 may also feature a display unit 225 to show the train operator a wide variety of intelligence gathered or calculated by the invention. The display unit 225 may feature the aspect display 150 traditionally used in trains equipped with cab signal devices. Depending on which option is preferred, the rail vision system 10 may operate the aspect display 150 in any one of two ways. It may illuminate the aspect indicators only when signal aspect information is actually received from the upcoming wayside signal device. Consequently, the aspect indicators would not be illuminated as the train passes through those track segments that are not covered by wayside signal devices. Alternatively, the rail vision system 10 may operate the aspect display so that it always displays some indication whether or not the train is travelling on a track segment covered by a wayside signal device. Specifically, the aspect indicators could be illuminated to indicate the prevailing signal aspect as the train passes through those track segments that are covered by wayside signal devices. When passing through track segments not covered by a wayside signal device, however, the aspect display 150 could be illuminated to indicate a signal aspect that is one level more restrictive than that received from the last wayside signal device passed. Moreover, the rail vision system 10 could be used to operate the brakes as if it actually received such unsignaled signal aspects.

The display unit 225 may also feature a graphical display 250. This graphical display could be used to provide the train operator with the actual video image generated by the camera 10. It may also be used to display supplemental information such as the profile of the upcoming portion of railway track, the estimated distance required to brake the train, the territorial coverage of the railway operating authority or other data.

Another optional feature of the invention could be to incorporate overspeed protection into the rail vision system 10. The first signal output from the speed sensing device 213 may, of course, take the form of pulses at a frequency proportional to the rate at which the axle rotates. Using the first signal from the speed sensing device 213, the rail vision system 10 could be used to shutdown automatically the engine of the locomotive should the speed of the train exceed a predetermined value.

Refer now to a presently preferred second embodiment of the invention also illustrated in FIG. 1. The rail vision system 10 includes the signal locating system 100 and the rail navigation system 200 as indicated in the description of the first embodiment. The signal locating system 100 is used to isolate visually the upcoming wayside signal device and to read the information therefrom as the train approaches it. The rail navigation system 200 is used to determine the position that the train occupies on the railway track. It is also used to provide the signal locating system 100 with data as to the whereabouts of the upcoming wayside signal device relative to the position of the train. This enables the signal locating system 100 to isolate visually the upcoming wayside signal device and to provide the information read therefrom to the rail navigation system 200. In this second embodiment, however, the computer 240 of the rail navigation system 200 merely warns the train operator of the more restrictive signal aspects. Moreover, if the train operator fails to acknowledge the warning, the rail navigation system 200 imposes a penalty brake application.

The rail vision 10 therefore includes an acknowledgment input 260 and a means for imposing a penalty brake application 214. The acknowledgment input 260 provides its output to the computer 240 of the rail navigation system 200. It can be used to silence the audible warning devices that would be generated following a failure to respond to the more restrictive signal aspects. The means for imposing the penalty brake application 214 can take the form of any one of a wide variety of known arrangements. For example, a power feed circuit can be used to energize, and thus keep closed, an electropneumatic valve that if opened would vent the brake pipe to atmosphere and apply the brakes. The power feed circuit may also be used as an input to a modern brake control system through which to provide the same function.

Should the train operator fail to acknowledge the warning properly such as by braking the train, the computer 240 will brake the train. For example, should the speed of the train approach too close to the service brake curve, the train operator would be warned via an audible warning device. If the train operator does not initiate a brake application so that the train comports with the service braking profile, the computer 240 will automatically deenergize the power feed circuit to impose a penalty brake application to stop the train. Similarly, if the speed of the train should approach too close to the emergency brake curve, the train operator would again be warned. If the train operator does not apply the brakes so that the train comports with the emergency braking profile, the computer 240 will automatically impose a penalty brake application to stop the train. For the service braking profile, the penalty brake application would normally be imposed at a full service rate. For the emergency braking profile, it could be imposed at an emergency rate.

It should be apparent that the rail vision system 10 can be configured to respond in any number of ways to signal aspect information. The first embodiment, for example, primarily is used to operate the brakes in compliance with the wayside signaling system in a manner similar to that of an automatic train protection system. The second embodiment is used primarily to detect the more restrictive signal aspects and impose a penalty brake application if the train operator fails to acknowledge them. In either embodiment, the invention can be used with existing signaling systems without the need to modify such infrastructure.

The display unit 225, of course, may be used to show the signal aspects received from the upcoming wayside signal device as well as other intelligence gathered or calculated by the system 10. This includes the actual video image generated by the camera 10 and supplemental information such as the profile of the upcoming portion of railway track and the territorial coverage of the railway operating authority as well as other data.

Figure 2:
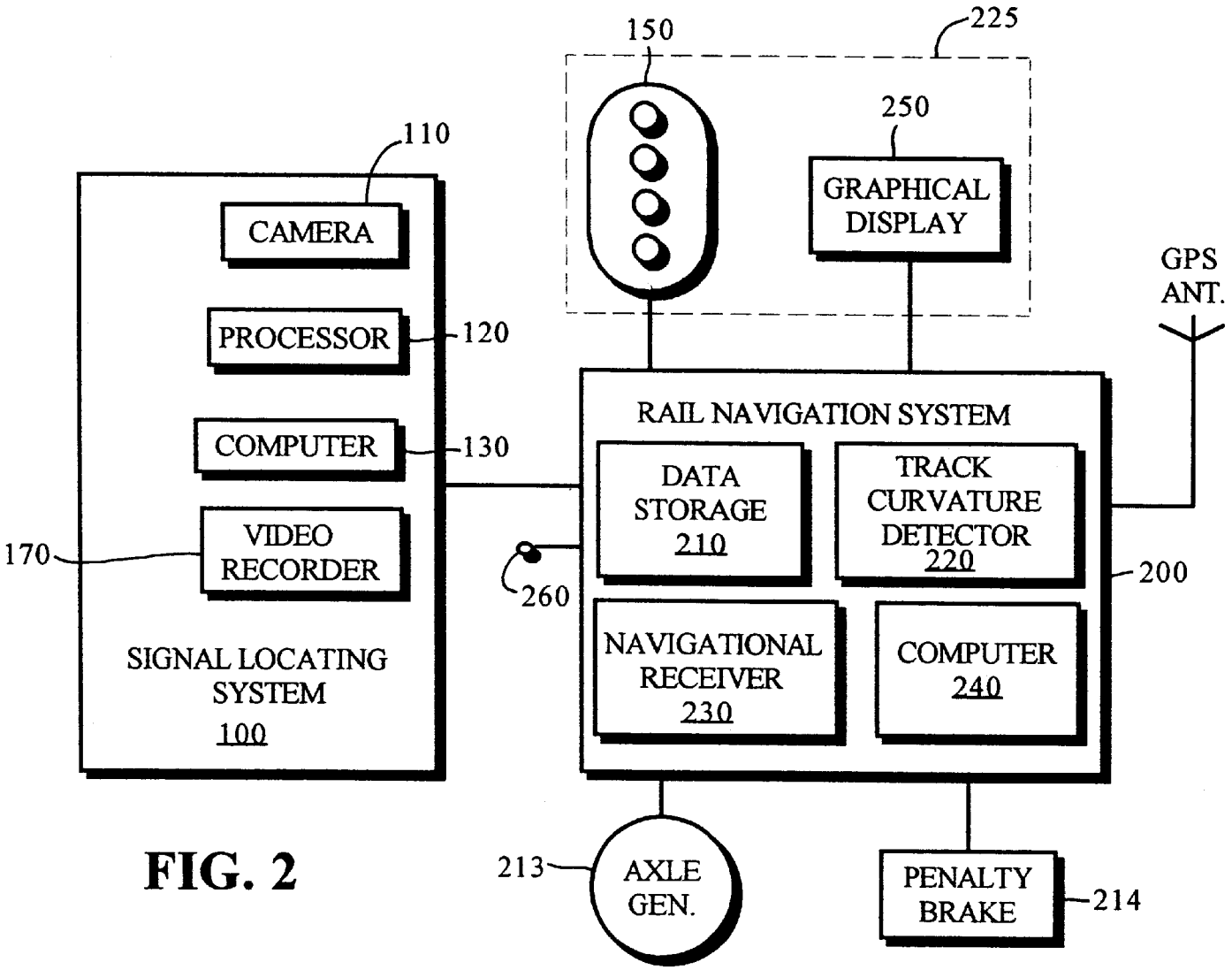
FIG. 2 illustrates in block form a third presently preferred embodiment of a rail vision system for a train.

Referring now to a presently preferred third embodiment of the invention, the rail vision system 10 may also be used to detect and react to obstructions on the railway track. Illustrated also in FIG. 2, this third embodiment is designed for trains that travel along railway routes that intersect with highways or other types of railway track crossings.

Whether this obstruction detection function is implemented by itself or added to the first or second embodiments of the invention, the rail vision system 10 includes the signal locating system 100 and the rail navigation system 200 as indicated in the description of the first and second embodiments. The database stored in storage device 210, however, will include the location of every highway or other type of crossing on each railway route. The database will also preferably include data pertaining to the distance from each crossing at which imaging should start.

As described previously, the computer 240 uses the enumerated signals along with and in comparison to the aforementioned data to determine the position that the train occupies on the railway route. Most important to this third embodiment, the computer 240 will also calculate the whereabouts of the upcoming crossing relative to the position of the train. Apprised of the expected location of the crossing by computer 240, the computing device 130 of the signal locating system 100 directs the camera 110 to focus on the upcoming crossing. The processing means 120 attempts to render the upcoming crossing discernable by processing the video signal generated by camera 110 according to known signal processing techniques. As the train approaches closer to the crossing, the computing device 130 conveys to computer 240 increasingly accurate information as to whether there is an obstruction on the crossing and, if so, whether that obstruction is stationary or moving. As with the previously described embodiments, the computing device 130 can also provide a confidence factor based on the quality of the sighting. The sighting of the crossing may also be used to corroborate the calculations of the computer 240 as to, for example, the track on which the train is traveling and the position that the train occupies on that track. The upcoming crossing and whatever obstruction may be blocking it can be displayed on the display unit 225 along with any other intelligence gathered or calculated by the system 10.

Unless the upcoming crossing is clear or the obstruction soon moves from it, the rail vision system 10 will warn the train operator of the obstruction via an audible or visual warning. Though the train may not be able to stop within the viewing distance to the upcoming crossing, the rail vision system 10 will provide the train operator with a warning in advance of the time at which the obstruction would otherwise be viewable by the train operator. The train operator will thus be alerted to apply the brakes far earlier than would otherwise be possible and thereby lower the speed at which the train will encounter the crossing.

It should be apparent that should the train operator fail to acknowledge the warning, the computer 240 could also be used to brake the train. For example, if the train operator does not initiate a brake application within a given time, the computer 240 could be used to deenergize automatically the power feed circuit 214 thereby imposing a penalty brake application to stop the train.

This third embodiment of the rail vision system 10 may also feature a video recorder 170. The computer 240 could be used to activate the video recorder 170 when an obstruction is detected on the upcoming crossing. The video recorder 170 could take the form of a magnetic tape recorder. Alternatively, a computer hard drive may be used to store in digital format the visual record of any such event. Such a video record would ideally be used to assist accident investigators in ascertaining the cause of collisions at highway crossings.

It should be apparent that the obstruction detection and video recording functions, as with various other features and functions, can be incorporated into any of the other embodiments of the invention described in this document.

The presently preferred embodiments for carrying out the invention have been set forth in detail according to the Patent Act. Those persons of ordinary skill in the art to which this invention pertains may nevertheless recognize various alternative ways of practicing the invention without departing from the spirit and scope of the appended claims. Those of such skill will also recognize that the foregoing description and drawings are merely illustrative and not intended to limit any of the ensuing claims to any particular narrow interpretation.

Accordingly, to promote the progress of science and the useful arts, I secure for myself by Letters Patent exclusive rights to all subject matter embraced by the following claims for the time prescribed by the Patent Act.

I claim:

1. A rail vision system for a train, such train for travelling along a railway track featuring a multiplicity of wayside signal devices each of which situated along such railway track so as to communicate from a railway operating authority information including directions as to how such train should proceed along a segment of such railway track generally corresponding thereto, said rail vision system comprising:

(a) a signal locating system for isolating visually an upcoming one of such wayside signal devices when such train approaches thereto and for reading said information when available therefrom; and (b) a rail navigation system for determining a position such train occupies on such railway track and for providing said signal locating system with data as to whereabouts of such upcoming wayside signal device relative to said position of such train thereby enabling said signal locating system (i) to isolate visually such upcoming wayside signal device when such train approaches thereto and (ii) to provide said information when read from such upcoming wayside signal device to said rail navigation system so that said rail navigation system can operate brakes of such train in compliance with such wayside signaling system.

2. The rail vision system recited in claim 1 wherein said rail navigation system includes:

(a) a storage device for storing a database including data pertaining to (i) locations of railway track routes, (ii) locations and orientations of curves and switches in such railway track routes, (iii) type and location of each of such wayside signal devices on such railway track routes, (iv) direction to which each such wayside signal device points and a particular track which each such wayside signal device signals, (v) position of each such wayside signal device with respect to such particular track and to said direction which such train is travelling, (vi) distance from each such wayside signal device at which said signal locating system should start isolating visually such upcoming wayside signal device, (vii) a signal number that appears on a signboard of each such wayside signal device so equipped, and (viii) position of such signboard for each of such wayside signal devices so equipped;

(b) a speed sensing device for sensing rotation of a wheel of such train to generate a first signal from which at least one of speed of and distance traveled by such train can be determined;

(c) a rate of turn measuring apparatus for measuring a rate at which such train turns while traveling on a curve of such railway track to generate a second signal from which curvature of such railway track can be determined;

(d) a navigational receiver for receiving positional coordinates that such train occupies and for generating a third signal indicative of an approximate position of such train on such railway track; and (e) a computer, according to instructions contained within programming code, for using said signals along with and in comparison to at least some of said data to determine said position such train occupies on such railway track and to determine for said signal locating system said data as to whereabouts of such upcoming wayside signal device thereby so enabling said signal locating system so that said computer can so operate such brakes of such train in compliance with such wayside signaling system.

3. The rail vision system recited in claim 2 wherein said signal locating system includes:

(a) an input means for generating a video signal indicative of an image of an object;

(b) a processing means for digitally processing said video signal so that such object, and said information if appearing thereon, is rendered discernable; and (c) a computing device for using said whereabouts data to manipulate said input means to focus on such upcoming wayside signal device when such train approaches thereto thereby enabling said processing means to provide said information to said computer so that said computer can so operate such brakes of such train in compliance with such wayside signaling system.

4. The rail vision system recited in claim 1 wherein:

(a) said signal locating system can isolate visually an upcoming one of a crossing when such train approaches thereto; and (b) said rail navigation system provides said signal locating system with data as to whereabouts of such upcoming crossing relative to such position of such train thereby enabling said signal locating system to isolate visually such upcoming crossing and to inform said rail navigation system whether such upcoming crossing is obstructed so that said rail navigation system can warn a train operator of obstruction.

5. The rail vision system recited in claim 4 wherein said rail navigation system imposes a penalty brake application should such upcoming crossing continue to be obstructed and such train operator fail to acknowledge said warning.

6. The rail vision system recited in claim 5 further including a video recorder that said rail navigation system activates to make a video record of such upcoming crossing when such obstruction is detected thereon.

7. The rail vision system recited in claim 1 further including a display unit for displaying a plurality of intelligence including said information received from such upcoming wayside signal device.

8. The rail vision system recited in claim 1 further including overspeed protection for such train.

9. The rail vision system recited in claim 1 wherein said rail navigation system includes a means for warning a train operator of a more restrictive of said directions, and should such train operator fail to acknowledge said warning, impose a penalty brake application.

10. A rail vision system for a train, such train for travelling along a railway track featuring a multiplicity of wayside signal devices each of which situated along such railway track so as to communicate from a railway operating authority information including directions as to how such train should proceed along a segment of such railway track generally corresponding thereto, said rail vision system comprising:

(a) an input means for generating a video signal indicative of an image of an object onto which said input means is focused, such object including an upcoming one of such wayside signal devices;

(b) a processing means for digitally processing said video signal so that such object, and said information if appearing thereon, is rendered discernable;

(c) a storage device for storing a database including data pertaining to (i) locations of railway track routes, (ii) locations and orientations of curves and switches in such railway track routes, (iii) type and location of each of such wayside signal devices on such railway track routes, (iv) direction to which each such wayside signal device points and a particular track which each such wayside signal device signals, (v) position of each such wayside signal device with respect to such particular track and to said direction which such train is travelling, (vi) distance from each such wayside signal device at which imaging of such object should start, (vii) a signal number that appears on a signboard of each such wayside signal device so equipped, and (viii) position of such signboard for each of such wayside signal devices so equipped;

(d) a speed sensing device for sensing rotation of a wheel of such train to generate a first signal from which at least one of speed of and distance traveled by such train can be determined;

(e) a rate of turn measuring apparatus for measuring a rate at which such train turns while traveling on a curve of such railway track to generate a second signal from which curvature of such railway track can be determined;

(f) a navigational receiver for receiving positional coordinates that such train occupies and for generating a third signal indicative of an approximate position of such train on such railway track; and (g) a computer, according to instructions contained within programming code, for using said signals along with and in comparison to at least some of said data to determine a position such train occupies on such railway track and whereabouts of such upcoming wayside signal device relative to such position of such train so as to manipulate said input means to focus on such upcoming wayside signal device when such train approaches thereto thereby enabling said processing means to provide said information to said computer so that said computer can operate brakes of such train in compliance with such wayside signaling system.

11. The rail vision system recited in claim 10 wherein such object onto which said input means can be focused and which said processing means can render discernable includes an upcoming crossing such that:

(a) said database stored in said storage device also includes data pertaining to location of each of such crossings on such railway track routes and distance from each of such crossing at which imaging should start; and (b) said computer for using said signals along with and in comparison to at least some of said data to determine whereabouts of such upcoming crossing relative to such position of such train so as to manipulate said input means to focus on, and said processing means to discern, such upcoming crossing so that said computer can warn a train operator when such upcoming crossing is obstructed as such train approaches thereto.

12. The rail vision system recited in claim 11 wherein said computer imposes a penalty brake application should such upcoming crossing continue to be obstructed and such train operator fail to acknowledge said warning.

13. The rail vision system recited in claim 12 further including a video recorder that said computer activates to make a video record of such upcoming crossing when such obstruction is detected thereon.

14. The rail vision system recited in claim 10 wherein said computer uses at least said first signal from said speed sensing device to provide overspeed protection for such train should speed of such train exceed a predetermined value.

15. The rail vision system recited in claim 10 wherein said computer can warn a train operator of a more restrictive of said directions, and should such train operator fail to acknowledge said warning, impose a penalty brake application.

16. The rail vision system recited in claim 15 wherein such object onto which said input means can be focused and which said processing means can render discernable includes an upcoming crossing such that:

(a) said database stored in said storage device also includes data pertaining to location of each of such crossings on such railway track routes and distance from each such crossing at which imaging should start; and (b) said computer for using said signals along with and in comparison to at least some of said data to determine whereabouts of such upcoming crossing relative to such position of such train so as to manipulate said input means to focus on, and said processing means to discern, such upcoming crossing so that said computer can warn such train operator when such upcoming crossing is obstructed as such train approaches thereto.

17. The rail vision system recited in claim 16 wherein said computer imposes said penalty brake application should such upcoming crossing continue to be obstructed and such train operator fail to acknowledge said warning of obstruction.

18. The rail vision system recited in claim 17 further including a video recorder that said computer activates to make a video record of such upcoming crossing when such obstruction is detected thereon.

19. The rail vision system recited in claim 15 wherein said computer uses at least said first signal from said speed sensing device to provide overspeed protection for such train should speed of such train exceed a predetermined value.

20. A rail vision system for a train, such train for travelling along a railway track having a multiplicity of crossings intersecting therewith, said rail vision system comprising:

(a) an input means for generating a video signal indicative of an image of an object onto which said input means is focused, such object including an upcoming one of such crossings;

(b) a processing means for digitally processing said video signal so that such object and any obstruction thereon is rendered discernable;

(c) a storage device for storing a database including data pertaining to (i) locations of railway track routes, (ii) locations and orientations of curves and switches in such railway track routes, (iii) location of each of such crossings on such railway track routes, (iv) distance from each of such crossings at which imaging should start;

(d) a speed sensing device for sensing rotation of a wheel of such train to generate a first signal from which at least one of speed of and distance traveled by such train can be determined;

(e) a rate of turn measuring apparatus for measuring a rate at which such train turns while traveling on a curve of such railway track to generate a second signal from which curvature of such railway track can be determined;

(f) a navigational receiver for receiving positional coordinates that such train occupies and for generating a third signal indicative of an approximate position of such train on such railway track; and (g) a computer, according to instructions contained within programming code, for using said signals along with and in comparison to at least some of said data to determine a position such train occupies on such railway track and whereabouts of such upcoming crossing relative to such position of such train so as to manipulate said input means to focus on, and said processing means to discern, such upcoming crossing so that said computer can warn such train operator when such upcoming crossing is obstructed as such train approaches thereto.

21. A rail vision system for a train, such train for travelling along a railway track having a multiplicity of crossings intersecting therewith, said rail vision system comprising:

(a) a signal locating system disposed on a locomotive of such train for isolating visually an upcoming one of such crossings when such train approaches thereto; and (b) a rail navigation system for determining a position such train occupies on such railway track and for providing said signal locating system with whereabouts of such upcoming crossing relative to such position of such train thereby enabling said signal locating system to isolate visually such upcoming crossing and to inform said rail navigation system as to a condition of such upcoming crossing so that said rail navigation system can warn such train operator when such upcoming crossing is obstructed as such train approaches thereto.

* * * * *